US006540506B1

(12) United States Patent
Li

(10) Patent No.: US 6,540,506 B1
(45) Date of Patent: Apr. 1, 2003

(54) DISPOSABLE PIEZOELECTRIC LIGHTER

(76) Inventor: Kin Chung Li, 2211 S. Hacienda Blvd., Suite 107, Hacienda Heights, CA (US) 91754

( * ) Notice: Subject to any disclaimer, the term of this patent is extended or adjusted under 35 U.S.C. 154(b) by 0 days.

(21) Appl. No.: 10/043,055

(22) Filed: Jan. 11, 2002

(51) Int. Cl.[7] ..... F23D 11/36; F23Q 7/12
(52) U.S. Cl. ..... 431/153; 431/255
(58) Field of Search ..... 431/153, 255

(56) References Cited

U.S. PATENT DOCUMENTS

| | | | | | |
|---|---|---|---|---|---|
| 4,786,248 | A | * | 11/1988 | Nitta | 431/255 |
| 5,971,751 | A | * | 10/1999 | Lee | 431/255 |
| 6,039,562 | A | * | 3/2000 | Li | 431/153 |
| 6,077,071 | A | * | 6/2000 | Yeh | 431/153 |
| 6,186,772 | B1 | * | 2/2001 | Huang | 431/132 |
| 6,267,582 | B1 | * | 7/2001 | Lin | 431/153 |
| 6,402,506 | B1 | * | 6/2002 | Lin | 431/153 |

* cited by examiner

*Primary Examiner*—Henry Bennett
*Assistant Examiner*—Alfred Basichas
(74) *Attorney, Agent, or Firm*—Raymond Y. Chan; David and Raymond Patent Group

(57) ABSTRACT

A disposable piezoelectric lighter includes a piezoelectric unit disposed in a casing for generating piezoelectricity and a resilient element for applying a press resistance to the piezoelectric unit. The piezoelectric unit includes a base body and a plunger body, having an enlarged plunger head, upwardly extended from the base body. The resilient element, coaxially mounted on the plunger body, has two ends biasing against a bottom side of the plunger head and a ceiling of the base body. The press resistance of the resilient element is an additional force added to the piezoelectric unit. Therefore, the additional force is adapted for resisting a downwardly pressing force applied by an under age child on an ignition button while an adult is capable of pushing down the ignition button to ignite the disposable piezoelectric lighter.

20 Claims, 5 Drawing Sheets

DISPOSABLE PIEZOELECTRIC LIGHTER

BACKGROUND OF THE PRESENT INVENTION

1. Field of Invention

The present invention relates to a disposable lighter, and more particularly to a disposable piezoelectric lighter for not only preventing under age children from using the lighter but also enhancing the gas releasing actuation configuration of the lighter.

2. Description of Related Arts

Nowadays, both U.S. government and U.S. Consumer Product Safety Commission demand a safety device in every cigarette lighter including the disposable lighter to prevent an unwanted ignition accidentally or by a child. As it is known that the disposable lighter is common and relatively cheap, it is impossible to incorporate with expensive and complex safety device that highly increases the cost of the disposable lighter.

A conventional piezoelectric lighter comprises a piezoelectric unit positioned under a pusher button in such a manner that when the pusher button is pressed downwardly, the piezoelectric unit is compressed for generating piezoelectricity so as to ignite the piezoelectric lighter. The piezoelectric unit comprises an internal spring for urging an upper moving part of the piezoelectric unit in a normally upward position. The downward force applied on the moving part must be greater than a predetermined spring force of the internal spring in order to compress the piezoelectric unit to ignite the lighter.

In order to prevent the piezoelectric lighter from being, ignited by the children, a stronger internal spring that provides a greater spring force can be used such that the children do not have enough power to press the pusher button downwardly. However, the stronger internal spring may have an adverse effect on the actuation of the piezoelectric unit and leads an erroneous ignition of the piezoelectric lighter. Moreover, the piezoelectric unit has limited space for the internal spring installed thereinto. It is costly to manufacture the internal spring with a relative small size but having strong spring force and it is very difficult to physically receive and retain the strong spring in the small spring chamber of the relatively small piezoelectric unit. Moreover, it a strong spring is used, the connection configuration of the moving part of the piezoelectric unit must be changed accordingly in order to hold and secure the strong spring therein. Therefore, it is unreasonable to incorporate the internal spring with higher manufacturing cost for the disposable piezoelectric lighter.

Furthermore, not all the countries demand the childproof feature for the lighter such that it is a hassle for the manufacturer to manufacture the piezoelectric unit with strengthen internal spring for those demanded countries and the piezoelectric unit with a regular internal spring for the rest of the countries.

Accordingly, it is apparent that a kind of disposable lighter with the childproof device that can prevent the ignition of the lighter by the child while being cost effective is desired by all disposable lighter users. Related arts of which the present inventor is aware and their differences and distinctions with respect to the present invention are discussed as follows.

U.S. Pat. No. 6,267,582, owned by Lin, discloses a piezoelectric lighter incorporated with at least an actuator spring for contributing a second predetermined force to a total force required to operate a thumb actuator. However, such piezoelectric lighter has several drawbacks. During the ignition of the lighter, the downward force applied on the thumb button should substantially compress both the actuator spring and the internal spring of the piezoelectric unit at the same time. Due to the difference of the spring forces of the actuator spring and the internal spring, the two springs may not be compressed at the same moment. Therefore, two continuous intervals of downward force may be required to compress the actuator spring and the internal spring respectively, which leads to different operational results depending on the users.

Thus, the piezoelectric lighter must alter its original structure to fit the actuator spring installed thereinto. Accordingly, the piezoelectric lighter requires an outlet tube with a predetermined length to mount between the gas container and the outlet valve such that the actuator spring can coaxially mounted on the outlet tube. Since the outlet valve must be upwardly extended to a position closed to the flame port of the casing, the spark tip of the piezoelectric unit must also be extended to the outlet valve in order to effectively ignite the ejected gas therefrom. It is dangerous when the spark tip is close to the flame port of the casing. Moreover, the lever must be modified in order to pivotally lift up the outlet value. Furthermore, the piezoelectric lighter requires more space to install the actuator spring which is positioned on top of the piezoelectric unit, such that the size of the piezoelectric lighter must be substantially increased.

U.S. Pat. No. 6,077,071, owned by Yeh, discloses a piezoelectric lighter incorporated with a pressure absorbing device to provide an additional resisting force of the ignition trigger. The drawbacks of such piezoelectric lighter are the same as mentioned above such as requiring two continuous intervals of downward force may be required to ignite the lighter and more space to install the pressure absorbing device.

SUMMARY OF THE PRESENT INVENTION

The main object of the present invention is to provide a disposable piezoelectric lighter which not only prevents the lighter from being ignited accidentally or by children but also enhance the gas releasing actuation of the lighter.

Another object of the present invention is to provide a disposable piezoelectric lighter, wherein the resilient element is coaxially mounted to the piezoelectric unit in such a manner that the ignition of the lighter of the present invention requires a simple single-action operation to compress the resilient element and the piezoelectric unit at the same time instead of the conventional two-continuous-interval action operation.

Another object of the present invention is to provide a disposable piezoelectric lighter, wherein the lever of the lighter is incorporated with the resilient element so as to substantially reduce the length of the lever for pivotally lifting up the gas valve.

Another object of the present invention is to provide a disposable piezoelectric lighter, which does not require an additional space for installing the resilient element so as to substantially reduce the overall size of the disposable piezoelectric lighter of the present invention.

Another object of the present invention is to provide a disposable piezoelectric lighter, which does not need to alter its original structural design so as to minimize tile manufacturing cost of the present invention.

Accordingly, in order to accomplish the above objects, the present invention provides a disposable piezoelectric lighter, which comprises:

a casing receiving a liquefied gas storage;

a gas emitting nozzle communicating with the liquefied gas storage for controlling a flow of gas;

a gas lever, which is pivotally supported in the casing, having a lifting end extended to the gas emitting nozzle and a depressing end arranged to be pressed downwardly to pivotally lift up the lifting end for releasing the gas from the liquefied gas storage through the gas emitting nozzle;

a piezoelectric unit, which is disposed in the casing for generating piezoelectricity, comprising a base body, a plunger body, having an enlarged plunger head, upwardly extended from the base body in a vertical movable manner and an ignition tip extended to a position close to the gas emitting nozzle wherein the depressing end of the gas lever is mounted to the plunger body in such a manner that when the plunger body is depressed downwardly, the ignition tip generates sparks to ignite the gas emitted from the gas emitting nozzle;

an ignition button slidably mounted on the casing in an upwardly movable manner, wherein the ignition button is coupled with a top end of the piezoelectric unit and arranged in such a manner that when the ignition button is pushed downwardly, the plunger body of the piezoelectric unit is depressed, which drives the depressing end of the gas lever downwardly, to ignite the disposable piezoelectric lighter; and a resilient element coaxially mounted on the plunger body and retained the depressing end of the gas lever in position, wherein the resilient element has tool ends biasing against a bottom side of the plunger head and a ceiling of the base body for applying a press resistance to the plunger body, wherein the press resistance is an additional force added to the piezoelectric unit for resisting a downwardly pressing force applied by an under age child on the ignition button while an adult is capable of pushing down the ignition button to ignite the disposable piezoelectric lighter.

DETAILED DESCRIPTION OF THE PREFERRED EMBODIMENT

Figure 1:
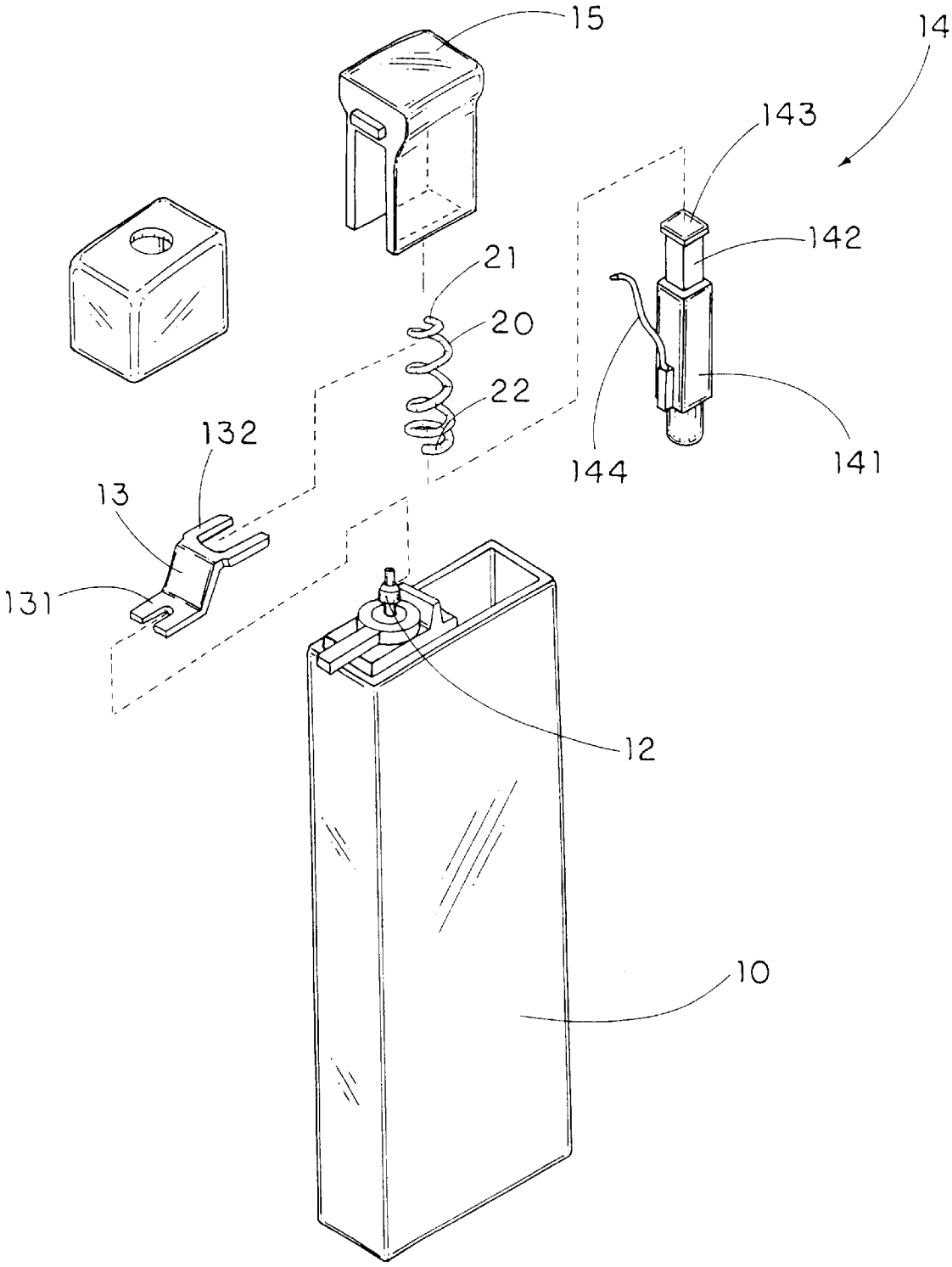
FIG. 1 is an exploded perspective view of a disposable piezoelectric lighter according to a first preferred embodiment of the present invention.
Figure 2:
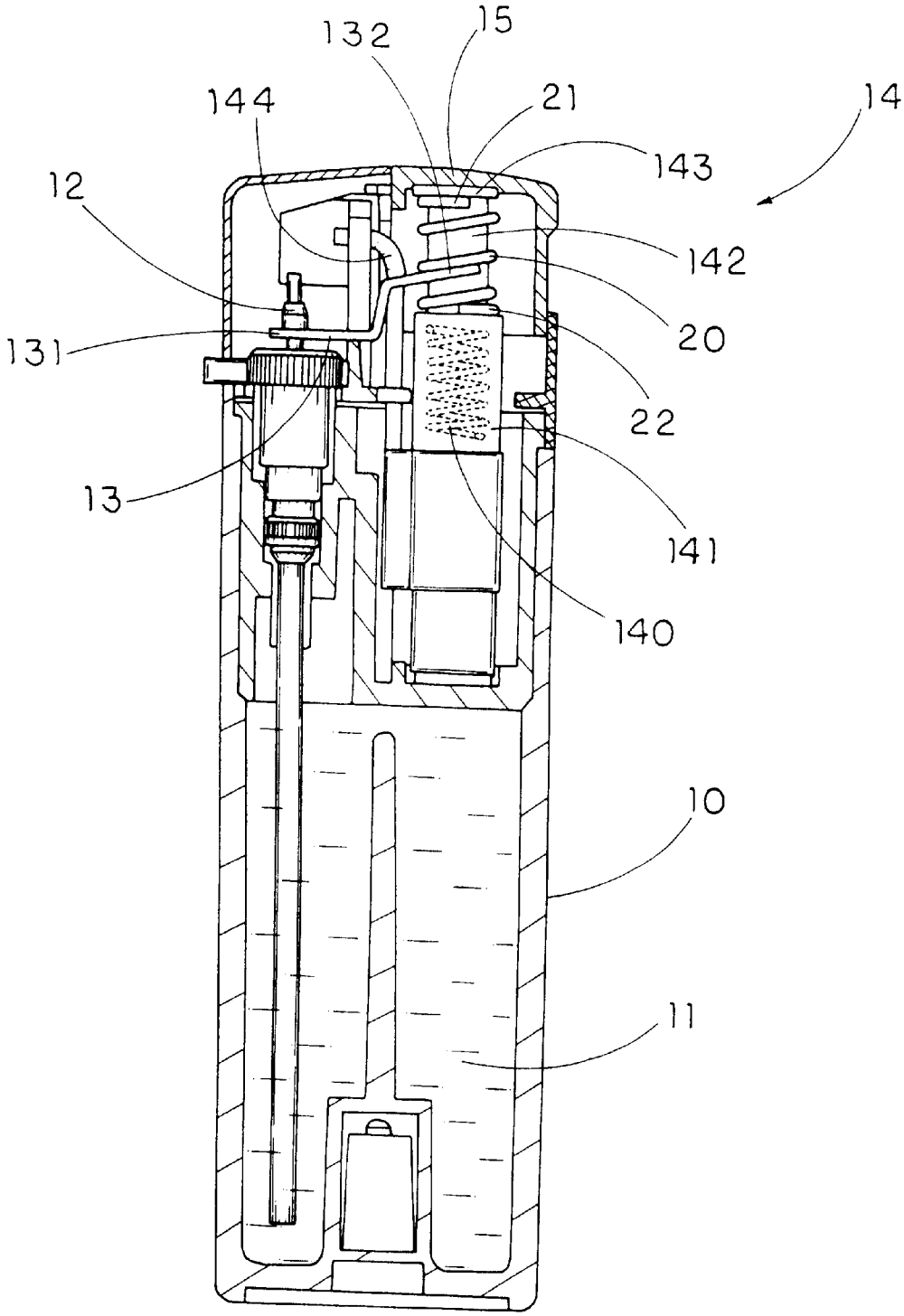
FIG. 2 is a sectional view of the disposable piezoelectric lighter according to the above first preferred embodiment of the present invention.

Referring to FIGS. 1 and 2 of the drawings, a disposable piezoelectric lighter according to a first preferred embodiment of the present invention is illustrated. The disposable piezoelectric lighter, such as a standard piezoelectric lighter, comprises a casing 10 having a liquefied gas storage 11 and a gas emitting nozzle 12 communicating with the liquefied gas storage 11 for controlling a flow of gas.

A gas lever 13, which is pivotally supported in the casing 10, has a lifting end 131 extended to the gas emitting nozzle 12 and a depressing end 132 arranged to be pressed downwardly to pivotally lift up the lifting end 131 for releasing the gas from the liquefied gas storage 11 through the gas emitting nozzle 12.

A piezoelectric unit 14, which is disposed in the casing 10 for generating piezoelectricity, comprises a base body 141, a plunger body 142 which has an enlarged plunger head 143 upwardly extended from the base body 141 in a vertical movable manner, and an ignition tip 144 extended to a position close to the gas emitting nozzle 12 in such a manner that when the plunger body 142 is depressed downwardly, the ignition tip 144 generates sparks to ignite the gas emitted from the gas emitting nozzle 12.

An ignition button 15 is slidably mounted on the casino 10 in an upwardly movable manner at a position that on top of the piezoelectric unit 14, wherein the depressing end 132 of the gas lever 13 is mounted to the plunger body 142 in such a manner that when the ignition button 15 is pushed downwardly, the plunger body 142 of the piezoelectric unit 14 is depressed that drives the depressing end 132 of the gas lever 13 downwardly to ignite the disposable piezoelectric lighter.

The disposable piezoelectric lighter further comprises a resilient element 20 coaxially mounted on the plunger body 142 and retained the depressing end 132 of the gas lever 13 in position. The resilient element 20 has two ends biasing against a bottom side of the plunger head 143 and a ceiling of the base body 141 for applying a press resistance to the plunger body 142.

According to the preferred embodiment, the resilient element 20, which is a compression spring, is constructed by a plurality of loops integrally and coaxially extended with each other in a spiral manner, wherein the resilient element 20 has a top fiat loop 21 having a diameter smaller than a width of the plunger head 143 and a bottom flat loop 22 having a diameter smaller than a width of the base body 141 in such a manner that the resilient element 20 is securely retained around the plunger body 142 while the top and bottom flat loops 21, 22 of the resilient element 20 is fixedly biased against the bottom side of the plunger head 143 and the ceiling of the base body 141 respectively.

Accordingly, the piezoelectric unit 14 is a standard piezoelectric unit that comprises an internal spring 140 installed into the base body 141 for providing an urging pressure against the plunger body 142 in a normal upward position. Therefore, alter the ignition button 15 is pressed downwardly to compress the piezoelectric unit 14, the compressed internal spring is arranged to push the plunger body 142 upwardly to its original position.

The resilient element 20 is arranged to apply the press resistance to the plunger body 142 wherein the press resistance is an additional force added to the piezoelectric unit 14, so that the additional force is adapted for resisting a downwardly pressing force applied by an under age child on the ignition button 15 while an adult is capable of pushing down the ignition button 15 to ignite the disposable piezoelectric lighter. Accordingly, the press resistance is the spring force of the resilient element 20 that is capable of storing therein.

Figure 3:
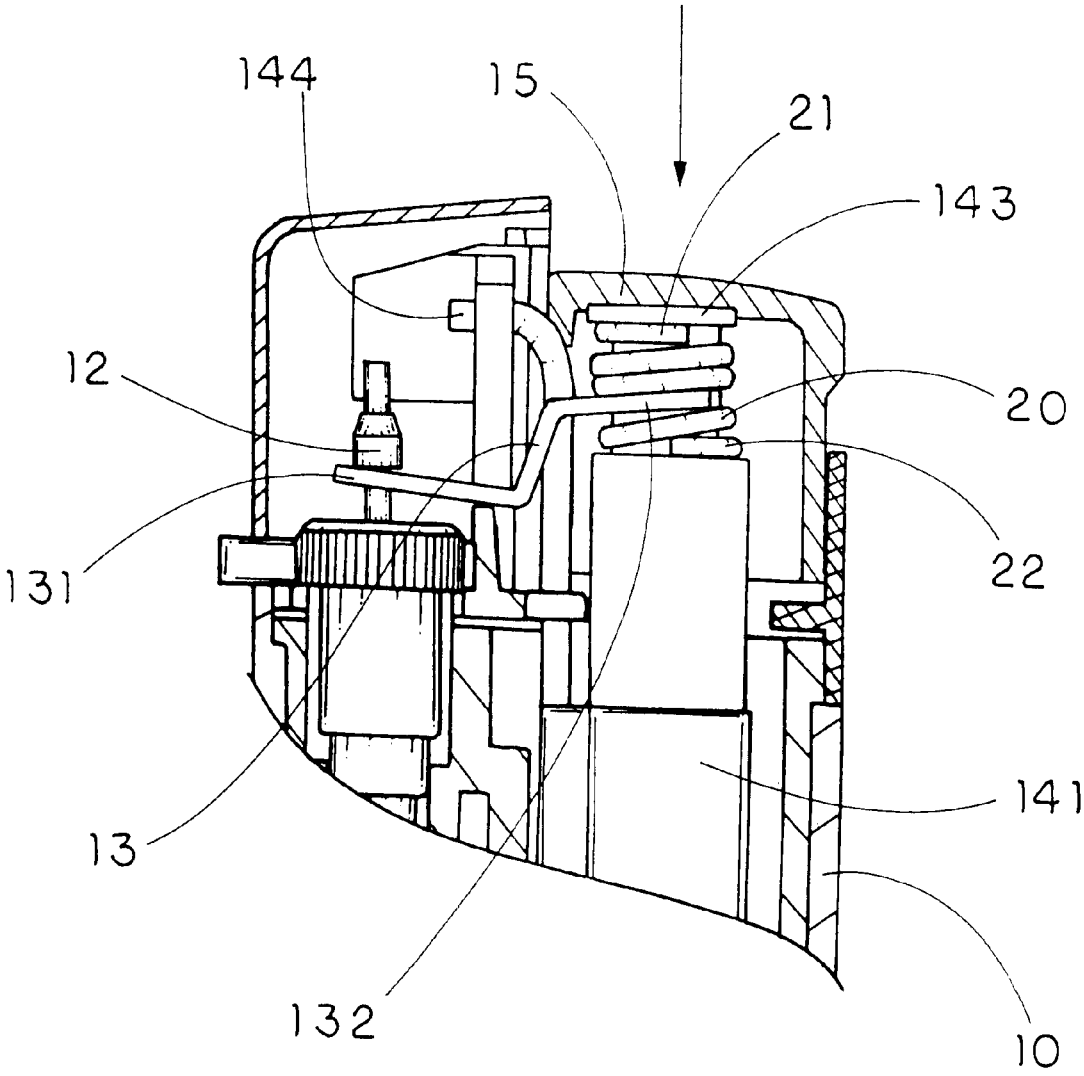
FIG. 3 is a partial sectional view of the disposable piezoelectric lighter in an ignited state according to the above first preferred embodiment of the present invention.

Since both the resilient element 20 and the internal spring are arranged to apply the urging pressures against the plunger body 142, a single continuous downward force applied on the ignition 15 must overcome the two urging pressures to compress the resilient element 20 and the internal spring at the same time in order to ignite the disposable piezoelectric lighter, as shown in FIG. 3.

In order to mount the resilient element 20 to the piezoelectric unit 14, the plunger body 142 is coaxially inserted into the bottom flat loop 22 of the resilient element 20. Since the size of the top flat loop 21 of the resilient element 20 is smaller than the size of the plunger head 143, the top flat loop 21 of the resilient element 20 can be slightly pulled to increase its diameter until the plunger head 143 is capable of inserting therethrough. Due to the elastic ability of the resilient element 20, the top flat loop 21 thereof will be rebounded to its original form so as to securely hold the resilient element 20 between the base body 141 and the plunger head 143 of the piezoelectric unit 14.

Therefore, by varying the spring force of the resilient element 20, a predetermined press resistance can be added into the piezoelectric unit 14 without altering the original structure of the piezoelectric unit 14. Moreover, the resilient element 20 does not require any installation space of the casing 10, so as to reduce the overall size of the disposable piezoelectric lighter of the present invention.

It is worth to mention that the resilient element 20 can be pre-installed into the piezoelectric unit 14 while manufacturing the piezoelectric unit 14 such that the entire resilient element 20 can have an even diameter from the top flat loop 21 to the bottom flat loop 22 thereof.

As shown in FIG. 2, the lifting end 131 of the gas lever 13 is engaged with the gas emitting nozzle 12 in such a manner that when the depressing end 132 of the gas lever 13 is pressed downwardly, the lifting end 131 of the gas level 13 lifts up the (as emitting nozzle 12 in an axially movable manner for releasing the gas in the liquefied glass storage 11 through the gas emitting nozzle 12.

The depressing end 132 of the gas lever 13, having a U-shaped, has two depressing arms 132*a*, 132*b* extended to engage with the resilient element 20 so as to retain the plunger body 142 between the two depressing arms 132*a*, 132*b* of the gas lever 13. Accordingly, the depressing arms 132*a*, 132*b* of the gas lever 13 are extended to a clearance between two loops of the resilient element 20, so as to retain the depressing end 132 of the gas lever 13 in position with respect to the plunger body 142. Therefore, when the ignition button 15 is pressed downwardly to compress the resilient element 20, the displacement of the resilient element 20 will drive the depressing end 132 of the gas lever 13 downward so as to pivotally lift up the lifting end 131 of the gas lever 13, as shown in FIG. 3.

In other words, a distance between the lifting end 131 and the depressing end 132 of the gas lever 13 can be reduced to provide a smooth pivotal movement of the gas lever 13, so as to further reduce the size of the casing 10. Accordingly, the size of the disposable lighter of the present invention can be reduced to a size approximately equal to two cigarettes.

Figure 4:
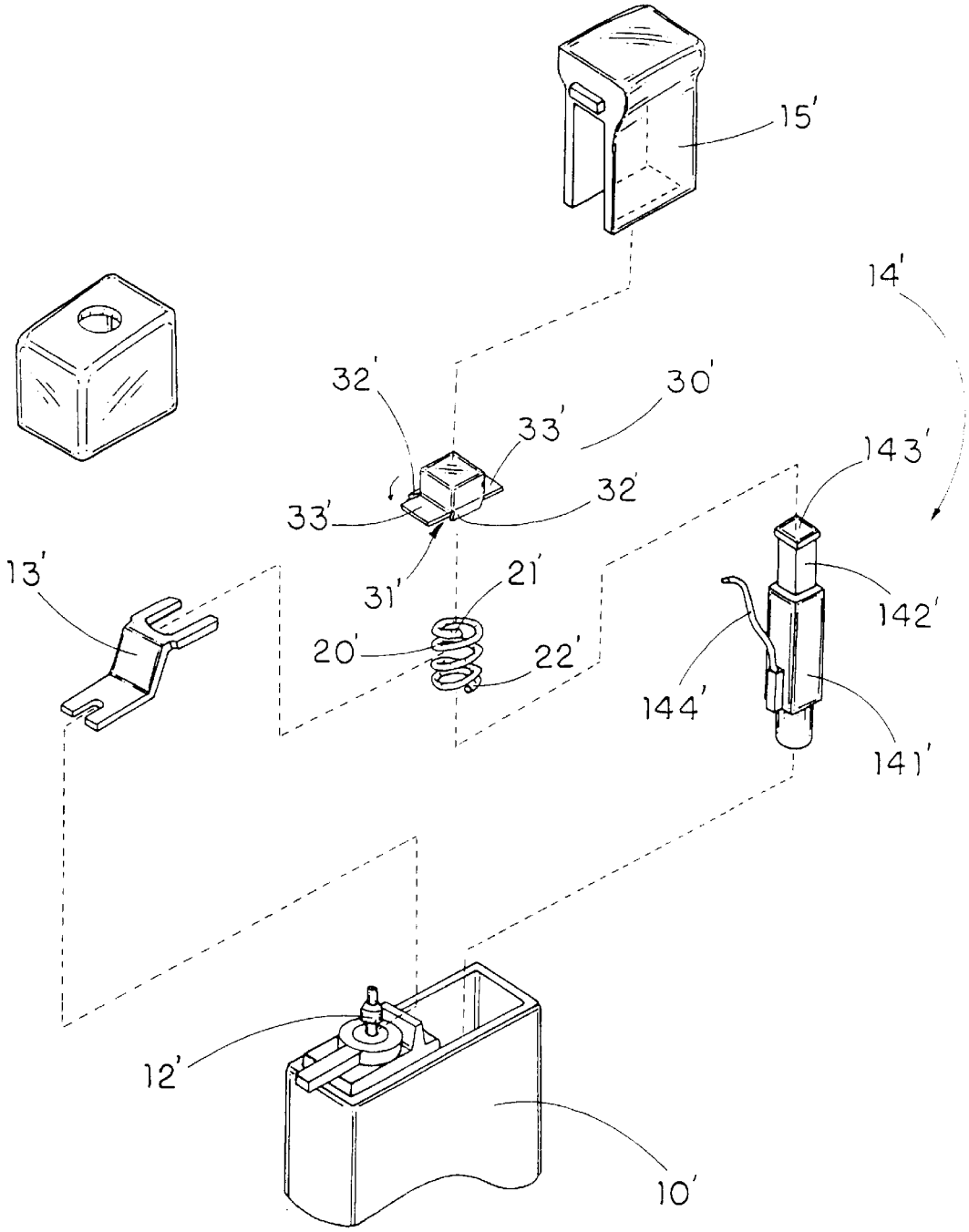
FIG. 4 is a partially exploded perspective view of a disposable piezoelectric lighter according to a second preferred embodiment of the present invention.

Referring to FIG. 4, a second embodiment of the disposable piezoelectric lighter illustrates an alternative mode of the present invention, wherein the disposable piezoelectric lighter comprises the basic elements such as casing 10', the liquefied gas storage 11', the gas emitting nozzle 12', and the gas lever 13'. The difference between the first and second embodiments is that the attachment between the piezoelectric unit 14' and the resilient element 20'.

As shown in FIG. 4, the piezoelectric unit 14' further comprises a mounting cap 30' attached on top of the piezoelectric unit 14' for retaining the resilient element 20' in position. The mounting cap 30' has a mounting cavity 31' that opens downwardly for fixedly receiving the plunger head 143' therein, two mounting wings 32' integrally extended from two opposed open edges of the mounting cavity 31 ' and arranged to fold inwardly to the bottom surface of the plunger head 143' so as to securely mount the mounting cap 30' on the plunger head 143', and two biasing wings 33' integrally extended from another two opposed open edges of the mounting cavity 31' and arranged to fold outwardly to bias against the top flat loop 21' of the resilient element 20'. In other words, the top flat loop 21' and the bottom flat loop 22' of the resilient element 20' are biased against the biasing wings 33' of the mounting cap 30' and the ceiling of the base body 141' of the piezoelectric unit 14' respectively.

Figure 5:
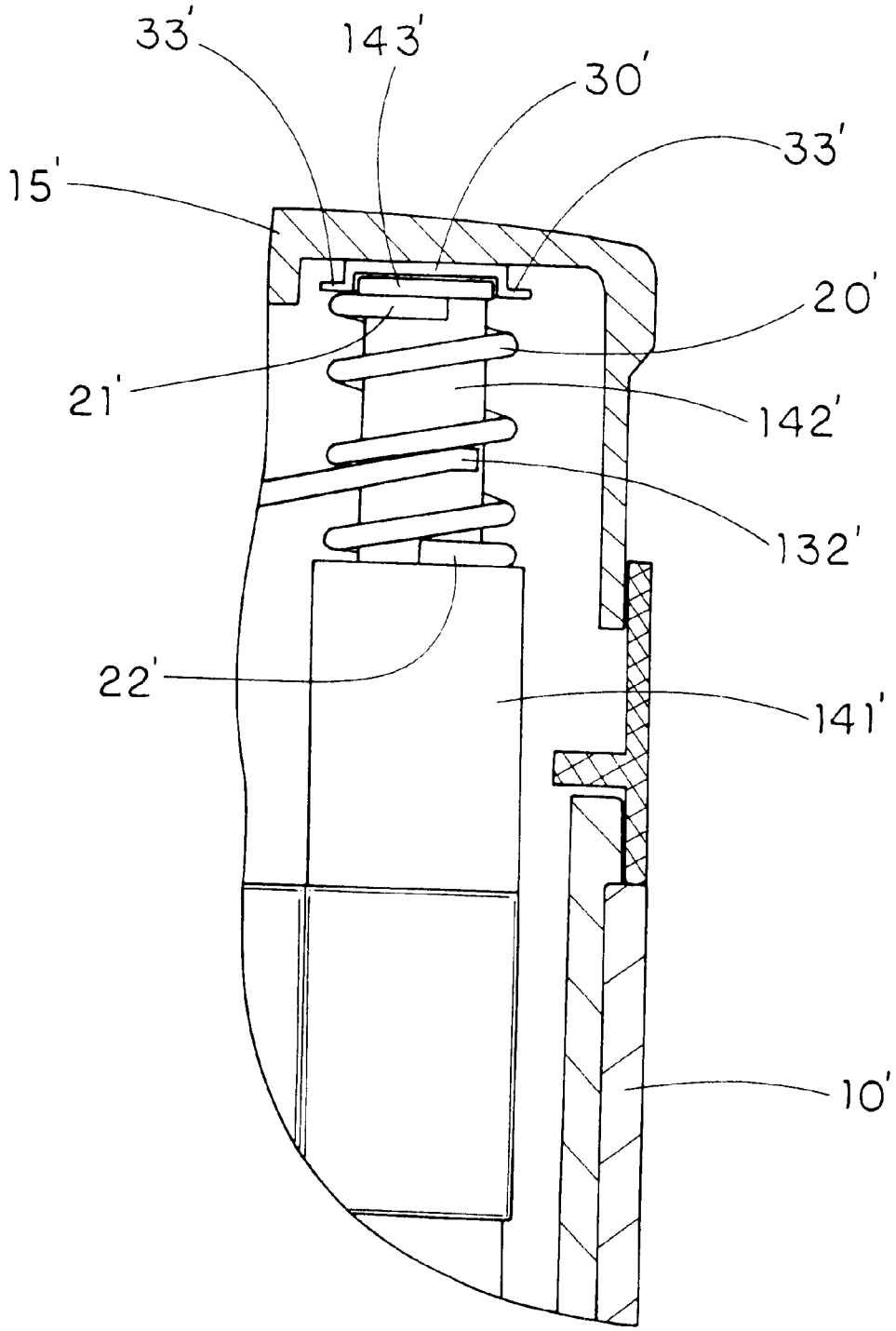
FIG. 5 is a partial sectional view of the disposable piezoelectric lighter according to the above second preferred embodiment of the present invention.

Accordingly, the size of the mounting cap 30' should have the same size of the base body 141' of the piezoelectric unit 14' such that the resilient element 20' with an even diameter can be coaxially mounted on the plunger body 142' of the piezoelectric unit 14'. Therefore, by coaxially inserting the resilient element 20' into the plunger body 142' until the bottom flat loop 22' of the resilient element 20' is biased against the ceiling of the base body 141', the mounting cap 30' is then attached on the plunger head 143' while the top flat loop 22' of the resilient element 20' is biased against the biasing wines 33' of the mounting cap 30', so that the resilient element 20' is securely retained between the base body 141' and the mounting cap 30', as shown in FIG. 5.

What is claimed is:

1. A disposable piezoelectric lighter, a casing receiving a liquefied gas storage;

a gas emitting nozzle communicating with said liquefied gas storage for controlling a flow of gas;

a gas lever, which is pivotally supported in said casing, having a lifting end extended to said gas emitting nozzle and a depressing end arranged to be pressed downwardly to pivotally lift up said lifting end for releasing said gas from said liquefied gas storage through said gas emitting nozzle;

a piezoelectric unit, which is disposed in said casing for generating piezoelectricity, comprising a base body a plunger body having an enlarged plunger head, upwardly extended from said base body in a vertical movable manner, and an ignition tip extended to a position close to said gas emitting nozzle in such a manner that when said plunger body is depressed downwardly, said ignition tip generates sparks to ignite said gas emitted from said gas emitting nozzle;

an ignition button slidably mounted on said casing in an upwardly movable manner and coupled on top of said piezoelectric unit, wherein said depressing end of said gas lever is mounted to said plunger body in such a manner that when said ignition button is pushed downwardly, said plunger body of said piezoelectric unit is depressed, which drives said depressing end of said gas lever downwardly, to ignite said disposable piezoelectric lighter; and a resilient element coaxially mounted on said plunger body for applying a press resistance to said plunger body, wherein said resilient element has a top end having a diameter smaller than a width of said plunger head, biasing against a bottom side of said plunger head and a bottom end, having a diameter smaller than a width of said base body, biasing against a ceiling of said base body, wherein said press resistance is an additional force added to said piezoelectric unit, so that said additional force is adapted for resisting a downwardly pressing force applied by an under age child on said ignition button while an adult is capable of pushing down said ignition button to ignite said disposable piezoelectric lighter.

2. A disposable piezoelectric lighter, as recited in claim 1, wherein said resilient element is constructed by a plurality of loops integrally and coaxially extended with each other in a spiral manner wherein said resilient element has a top flat loop biasing against said bottom side of said plunger head and a bottom flat loop biasing against said ceiling of said base body.

3. A disposable piezoelectric lighter, as recited in claim 1, wherein said depressing end of said gas lever, having a U-shaped, has two depressing arms extended to engage with said resilient element so as to retain the plunger body of the piezoelectric unit between said two depressing arms.

4. A disposable piezoelectric lighter, as recited in claim 2, wherein said depressing end of said gas lever, having a U-shaped, has two depressing arms extended to engage with said resilient element so as to retain the plunger body of the piezoelectric unit between said two depressing arms.

5. A disposable piezoelectric lighter, as recited in claim 4, wherein said two depressing arms of the gas lever are extended to a clearance between two loops of said resilient element, so as to retain said depressing end of said gas lever in position with respect to said plunger body.

6. A disposable piezoelectric lighter, as recited in claim 2, wherein said diameter of said top flat loop of said resilient element is smaller than said diameter of said bottom flat loop of said resilient element.

7. A disposable piezoelectric lighter, as recited in claim 4, wherein said diameter of said top flat loop of said resilient element is smaller than said diameter of said bottom flat loop of said resilient element.

8. A disposable piezoelectric lighter, as recited in claim 5, wherein said diameter of said top flat loop of said resilient element is smaller than said diameter of said bottom flat loop of said resilient element.

9. A disposable piezoelectric lighter, a casing receiving a liquefied gas storage;

a gas emitting nozzle communicating with said liquefied gas storage for controlling a flow of gas;

a gas lever, which is pivotally supported in said casing, having a lifting end extended to said gas emitting nozzle and a depressing end arranged to be pressed downwardly to pivotally lift up said lifting end for releasing said gas from said liquefied gas storage through said gas emitting nozzle;

a piezoelectric unit, which is disposed in said casing for generating piezoelectricity, comprising a base body, a plunger body upwardly extended from said base body in a vertical movable manner, and an ignition tip extended to a position close to said gas emitting nozzle in such a manner that when said plunger body is depressed downwardly, said ignition tip generates sparks to ignite said gas emitted from said gas emitting nozzle;

said piezoelectric unit further comprising a mounting cap attached on top of said plunger body;

an ignition button slidably mounted on said casing in an upwardly movable manner and coupled on top of said piezoelectric unit, wherein said depressing end of said gas lever is mounted to said plunger body in such a manner that when said ignition button is pushed downwardly, said plunger body of said piezoelectric unit is depressed, which drives said depressing end of said gas lever downwardly, to ignite said disposable piezoelectric lighter; and a resilient element coaxially mounted on said plunger body for applying a press resistance to said plunger body, wherein said resilient element has a top end, having a diameter smaller than a width of said mounting cap, biasing against a bottom side of said mounting cap and a bottom end, having a diameter smaller than a width of said base body, biasing against a ceiling of said base body, wherein said press resistance is an additional force added to said piezoelectric unit, so that said additional force is adapted for resisting a downwardly pressing force applied by an under age child on said ignition button while an adult is capable of pushing down said ignition button to ignite said disposable piezoelectric lighter.

10. A disposable piezoelectric lighter, as recited in claim 9, wherein said resilient element is constructed by a plurality of loops integrally and coaxially extended with each other in a spiral manner wherein said resilient element has a top flat loop biasing against said bottom side of said mounting cap and a bottom flat loop biasing against said ceiling of said base body.

11. A disposable piezoelectric lighter, as recited in claim 9, wherein said depressing end of said gas lever, having a U-shaped, has two depressing arms extended to engage with said resilient element so as to retain the plunger body of the piezoelectric unit between said two depressing arms.

12. A disposable piezoelectric lighter, as recited in claim 10, wherein said depressing end of said gas lever, having a U-shaped, has two depressing arms extended to engage with said resilient element so as to retain the plunger body of the piezoelectric unit between said two depressing arms.

13. A disposable piezoelectric lighter, as recited in claim 12, wherein said two depressing arms of the gas lever are extended to a clearance between two loops of said resilient element, so as to retain said depressing end of said gas lever in position with respect to said plunger body.

14. A disposable piezoelectric lighter, as recited in claim 13, wherein said resilient element has an even diameter from said top flat loop to said bottom flat loop thereof.

15. A disposable piezoelectric lighter, as recited in claim 9, wherein said plunger body of said piezoelectric unit has an enlarged plunger head such that said mounting cap is securely mounted on said plunger head.

16. A disposable piezoelectric lighter, as recited in claim 10, wherein said plunger body of said piezoelectric unit has an enlarged plunger head such that said mounting cap is securely mounted on said plunger head.

17. A disposable piezoelectric lighter, as recited in claim 12, wherein said plunger body of said piezoelectric unit has an enlarged plunger head such that said mounting cap is securely mounted on said plunger head.

18. A disposable piezoelectric lighter, as recited in claim 15, wherein said mounting cap has a mounting cavity that opens downwardly for fixedly receiving said plunger head therein, two mounting wings integrally extended from two opposed open edges of said mounting cavity and arranged to fold inwardly to a bottom surface of said plunger head so as to securely mount said mounting cap on said plunger head, and two biasing wings integrally extended from another two opposes open edges of said mounting cavity and arranged to fold outwardly to bias against said top flat loop of said resilient element.

19. A disposable piezoelectric lighter, as recited in claim 16, wherein said mounting cap has a mounting cavity that opens downwardly for fixedly receiving said plunger head therein, two mounting wings integrally extended from two opposed open edges of said mounting cavity and arranged to fold inwardly to a bottom surface oft said plunger head so as to securely mount said mounting cap on said plunger head, and two biasing wings integrally extended from another two opposes open edges of said mounting cavity and arranged to fold outwardly to bias against said top flat loop of said resilient element.

20. A disposable piezoelectric lighter, as recited in claim 17, wherein said mounting cap has a mounting cavity that opens downwardly for fixedly receiving said plunger head therein, two mounting wings integrally extended from two opposed open edges of said mounting cavity and arranged to fold inwardly to a bottom surface of said plunger head so as to securely mount said mounting cap on said plunger head, and two biasing wings integrally extended from another two opposes open edges of said mounting cavity and arranged to fold outwardly to bias against said top flat loop of said resilient element.

* * * * *